US006185755B1

(12) United States Patent
Shepherd et al.

(10) Patent No.: US 6,185,755 B1
(45) Date of Patent: Feb. 13, 2001

(54) APPARATUS FOR FLUSHING DRAIN PIPES

(76) Inventors: Charles G. Shepherd, deceased, late of Oakville (CA); by Marjorie E. Shepherd, executrix, 1008 Westdale Rd., Oakville, Ontario (CA), L6L 5A2; Glenn J. Parson, 18 M40 Clarendon Street, Wainfleet, Ontario (CA), L0S 1V0

( * ) Notice: Under 35 U.S.C. 154(b), the term of this patent shall be extended for 0 days.

(21) Appl. No.: 09/306,718

(22) Filed: May 7, 1999

Related U.S. Application Data

(60) Provisional application No. 60/085,006, filed on May 11, 1998.

(51) Int. Cl.[7] ..... E03C 1/306

(52) U.S. Cl. ..... 4/255.06; 4/255.08; 251/324

(58) Field of Search ..... 4/255.04, 255.06, 4/255.08, 255.01, 255.02, 255.03, 255.07, 255.09, 255.11, 255.12; 134/169 C; 251/324, 323

(56) References Cited

U.S. PATENT DOCUMENTS 1,314,261 * 8/1919 Griesche ..... 4/255.06
2,036,614 * 7/1936 Tharp ..... 4/255.07
2,490,422 * 12/1949 Denison ..... 4/255.07 X
4,144,598 * 3/1979 Li ..... 4/255.06
4,320,539 * 3/1982 Li ..... 4/255.06
5,064,168 * 11/1991 Raines et al. ..... 251/323 X
5,228,646 * 7/1993 Raines ..... 251/324 X
5,524,296 * 6/1996 Leighton ..... 4/255.05

* cited by examiner

*Primary Examiner*—Henry J. Recla
*Assistant Examiner*—Kathleen J. Prunner
(74) *Attorney, Agent, or Firm*—Robert F. Delbridge

(57) ABSTRACT

Apparatus for flushing a drain pipe with an accessible open end has a valve assembly with a hollow body connectable to a source of liquid under pressure for the supply of liquid under pressure to the interior of the hollow body, the hollow body having an open end positionable in communication with an open end of a drain pipe. A valve member is mounted for sliding movement in the valve body between a closed position in which the valve member prevents flow of liquid under pressure from a source thereof through the hollow body to the open end thereof, and an open position in which the valve member permits flow of liquid from the source thereof through the hollow body to the open end thereof. An actuating portion of the valve member is manually engageable to move the valve member by manual pressure to the open position against the action of a spring, when the open end of the hollow body has been positioned over the open end of a drain pipe and the hollow body has been connected to a source of fluid under pressure. The valve assembly is held against the open end of the drain pipe by the manual pressure and liquid under pressure from the source thereof flows through the hollow body into the drain pipe to flush undesirable matter therefrom and/or to dislodge blocking material in the pipe.

3 Claims, 3 Drawing Sheets

APPARATUS FOR FLUSHING DRAIN PIPES

This application claims priority from U.S. Provisional Patent Application No. 60/085,006 filed May 11, 1998.

This application relates to apparatus for flushing drain pipes of wash basins, sinks, showers, baths and the like which have a readily accessible open end.

BACKGROUND OF INVENTION

It is well known that drain pipes of wash basins, sinks, showers, baths and the like, such as floor drains, may become partially or completely blocked from time to time by material which has entered the drain pipe of a sink, bath or the like. Many different kinds of apparatus have been proposed for unblocking such drain pipes, particularly those having an accessible open end. For example, there is a well known plunger which has a rubber-like bell member which is placed over the open end of the blocked drain pipe, the bell member having a handle which enables the bell member to be moved up and down to apply pressure to blocked liquid in the pipe. However, it is frequently not possible to unblock a pipe with such a plunger because it does not enable a sufficient pressure to be applied. Another kind of apparatus for unblocking pipes is inserted into the blocked pipe and held therein by hydraulic pressure, with liquid under pressure being supplied from a convenient source, such as an adjacent faucet, through the apparatus to the blocking material. A problem with such apparatus is that it is usually not suitable for use by the average person but requires operation by a professional.

Such drains pipes, although not blocked, may also retain bacteria or other undesirable matter which it would be desirable to flush away.

It is therefore an object of the invention to provide drain flushing apparatus which is readily operated by an average person to clear a blocked drain pipe and/or to flush undesirable matter therefrom.

SUMMARY OF INVENTION

According to the invention, apparatus for flushing a drain pipe with an accessible open end includes a valve assembly with a hollow body connectable to a source of liquid under pressure for the supply of liquid under pressure to the interior of the hollow body, the hollow body having an open end positionable in communication with an open end of a drain pipe. A valve member is mounted for sliding movement in the valve body between a closed position in which the valve member prevents flow of liquid under pressure from a source thereof through the hollow body to the open end thereof, and an open position in which the valve member permits flow of liquid from the source thereof through the hollow body to the open end thereof, the valve member having an actuating portion projecting from an opposite end of the hollow body, and spring means biasing the valve member towards the closed position.

The actuating portion of the valve member is manually engageable to move the valve member by manual pressure to the open position against the action of the spring, when the open end of the hollow body has been positioned over the open end of a drain pipe and the hollow body has been connected to a source of fluid under pressure, whereby the valve assembly is held against the open end of the drain pipe by said manual pressure and liquid under pressure from the source thereof flows through the hollow body into the drain pipe to flush undesirable matter therefrom and/or to dislodge blocking material in the pipe.

The valve assembly may also include an annular adaptor mountable on the open end of the hollow valve body, the adaptor having a larger diameter tubular end portion engageable with the exterior of the open end of the hollow valve body, and a smaller diameter opposite end portion engageable with the open end of the hollow valve body.

DESCRIPTION OF THE DRAWINGS

One embodiment of the invention will now be described, by way of example, with reference to the accompanying drawings, of which.

DESCRIPTION OF PREFERRED EMBODIMENTS

Figure 2:
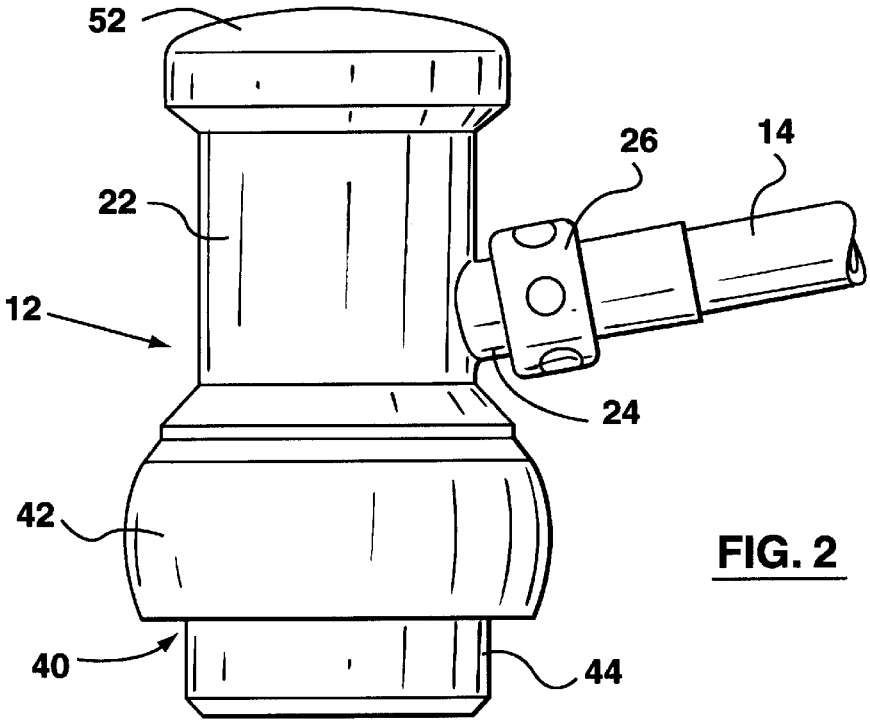
FIG. 2 is a side view of the valve assembly of the apparatus.
Figure 3:
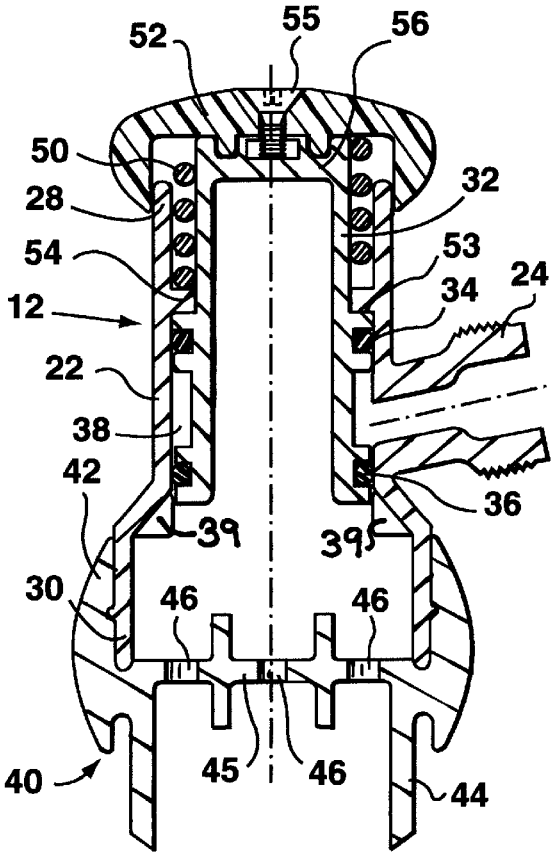
FIG. 3 is a sectional side view of the valve assembly of FIG. 2 in the closed position.
Figure 4:
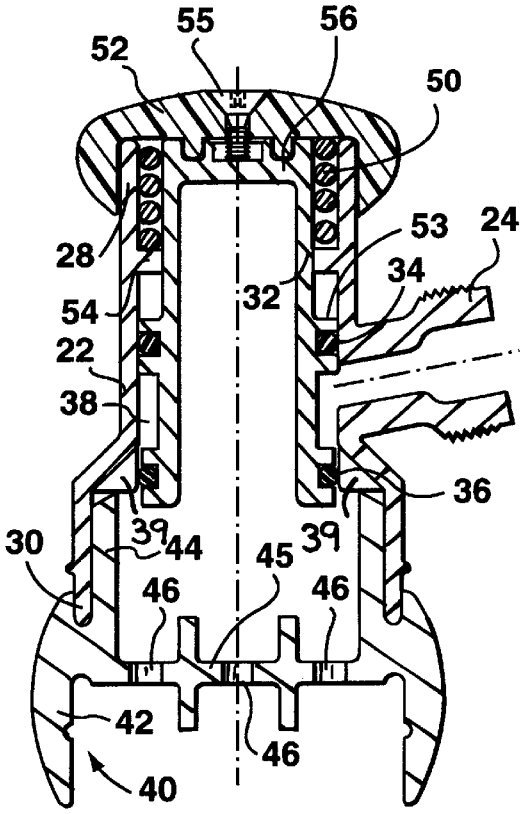
FIG. 4 is a similar view but showing the valve assembly in the open position.

Referring to the drawings, FIG. I shows apparatus for flushing drain pipes comprising a valve assembly 12 connected by a flexible hose 14 and connector 16 to the faucet 18 of a wash basin 20. As shown in FIGS. 2 to 4, the valve assembly 12 has a hollow body 22 with a laterally extending externally threaded inlet 24 to which the hose 14 is connectable by means of an internally threaded connector 26 secured to an end of the hose 14. Both the upper end 28 and the lower end 30 of the hollow body 22 are open, the lower end portion of the hollow body 22 being of somewhat greater diameter than the diameter of the upper portion of the hollow body 22.

A valve member 32 is mounted for sliding movement in the valve body 22 between an upper closed position shown in FIG. 3 and a lower open position shown in FIG. 4. The valve member 32 has a pair of vertically spaced sealing rings 34, 36 extending therearound above and below an external circumferential recess 38 in the valve member 32 adjacent the inlet 24. In the upper position of the valve member 32 as shown in FIG. 3, the sealing rings 34, 36 engage the hollow body 22 to prevent flow of liquid from the hose 14 through the hollow body 22. In the lower position of the valve member 32 as shown in FIG. 4, the lower sealing ring 36 is spaced from the hollow body 22 to permit flow of liquid from the inlet 24 through the recess 38 into the lower end portion of the valve body 22 and out through the lower end 30 thereof. Guides 39 spaced at intervals around the interior of the hollow body 22 guide the sealing ring 36 when it is spaced from the hollow body 22.

An annular adaptor 40 is mounted on the lower end 30 of the hollow body 22. In the position shown in FIGS. 3 and 4, a larger diameter tubular end portion 42 of the adaptor 40 is a press fit around the exterior of the lower end 30 of the hollow body 22. The opposite end portion 44 of the adaptor 40 is a smaller diameter tubular end portion which, if the adaptor 40 is reversed, is sized to be a press fit in the lower end 30 of the hollow body 22 for a reason which will be described later. Within the adaptor 40, a transversely extending wall 45 is provided with apertures 46 for liquid communication between the larger and smaller tubular end portions 42, 44.

A coil spring 50 within the hollow body 22 and surrounding the valve member 32 has its upper end engaging the bottom surface of a cap 52 and its lower engaging an annular stop 54 projecting inwardly from the valve body 22. The cap 52 is secured by a screw 55 to a transversely extending web 56 at the upper end of the valve member 32. The spring 50 resiliently urges the valve member 32 to its upper position in which the valve member 32 prevents flow of liquid from the hose 14 to the interior of the hollow body 22.

In the closed position, further upwardly movement of the valve member 32 is limited by engagement of an annular shoulder 53 extending around the valve member 32 with an annular shoulder 54 extending around the interior of the valve body 22. In the open position, the cap 52 engages the upper end 28 of the hollow body 22 as shown in FIG. 4 to prevent further downward movement of the valve member 32 as shown in FIG. 3.

In use, the hose 16 is secured to the faucet 18, which is then turned on. However, there is no flow of water from the faucet 18 through the valve assembly 12 because the valve member 32 is in its upper closed position as shown in FIG. 3. The smaller diameter tubular end portion 44 of the adaptor 40, with the valve assembly 12 attached thereto, is then placed over the open upper end 56 of the drain pipe of the wash basin 20. The operator then places his or her hand 58 on the cap 52 of the valve assembly 12 and pushes downwardly in a firm manner. This downward manual pressure has two functions. Firstly, the adaptor 40 is maintained firmly in engagement with the upper end 56 of the drain pipe of the wash basin 20. Secondly, the downward manual pressure compresses spring 50 so that the valve member 32 moves downwardly to the open position as shown in FIG. 4.

The water under pressure from the faucet 18 then flows through the valve body 22 and into the blocked drain pipe. Since domestic water pressure is relatively high, such pressure in the drain pipe will flush undesirable matter therefrom and will usually dislodge a blockage. Hand pressure on the cap 52 is then released, so that spring 50 moves the valve member 32 back up to the closed position as shown in FIG. 3. The faucet 18 can then be turned off and the apparatus disconnected therefrom.

Figure 5:
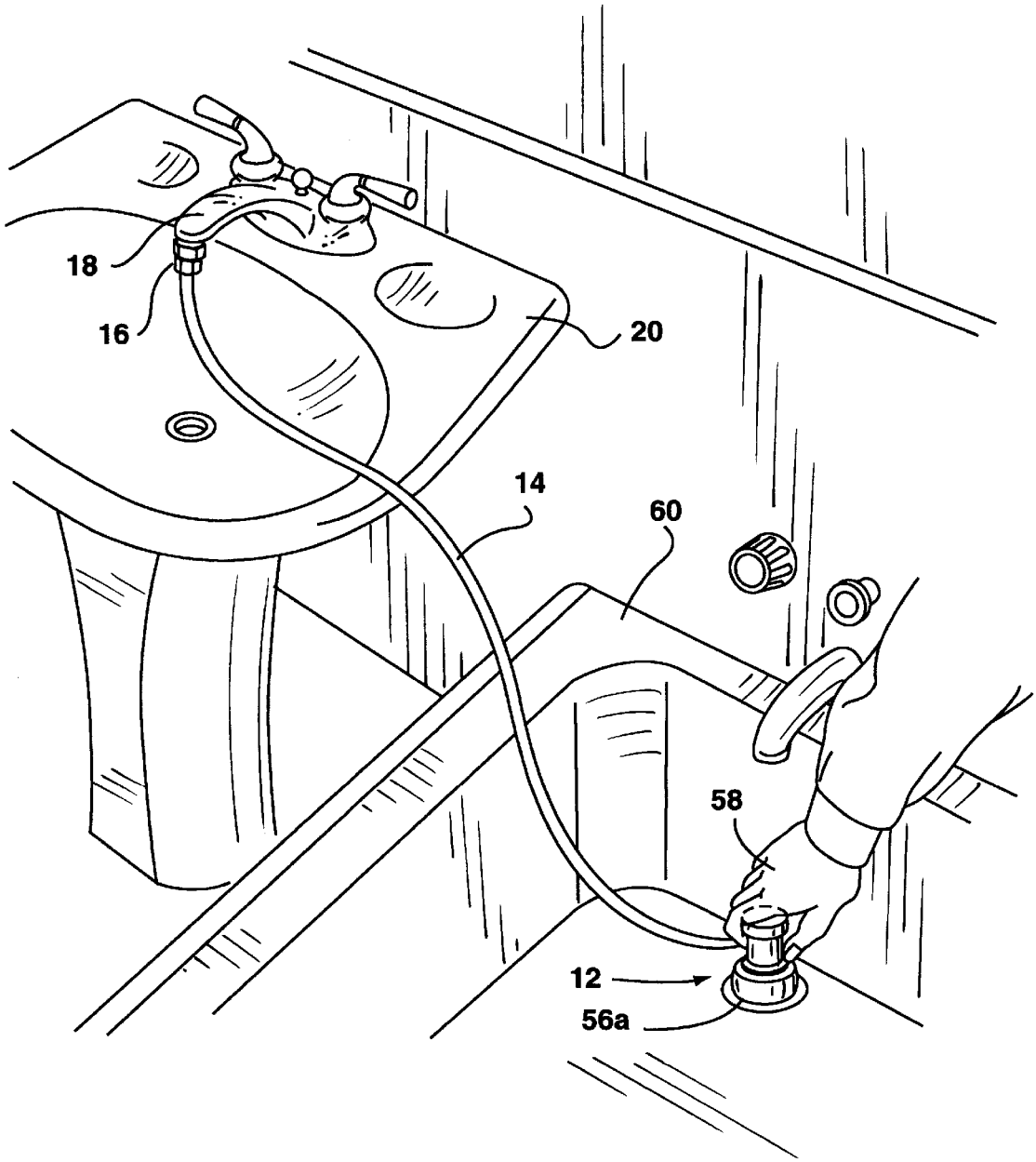
FIG. 5 is a pictorial view of the apparatus being used to flush a drain pipe of a bathtub.

Referring now to FIG. 5, the same apparatus can be used if a drain pipe of a bath 60 is blocked. However, since the open upper end 56*a* of the bath 60 has a somewhat larger diameter than the open upper end 56 of the wash basin 20, the adaptor 40 is first removed from the lower end 30 of the valve body 22 and reversed, that is to say the tubular end portion 44 is inserted into the lower end 30 of the valve member 22 so that the larger diameter tubular end portion 42 of the adaptor 40 is lowermost for placement over the open upper end 56*a* of the drain pipe of the bath 60.

The apparatus is used in a similar manner to that previously described. The hose 14 is again attached by the connector 16 to the faucet 18 of the wash basin 20 and the faucet 18 then turned on. The larger diameter tubular end portion 42 of adaptor 40, with the valve assembly 12 attached thereto, is then placed over the upper open end 56*a* of the drain pipe of the bath 60 and downward manual pressure applied to the cap 52 to flush any undesirable matter through the pipe and to free any blockage in the same manner as previously described.

Figure 1:
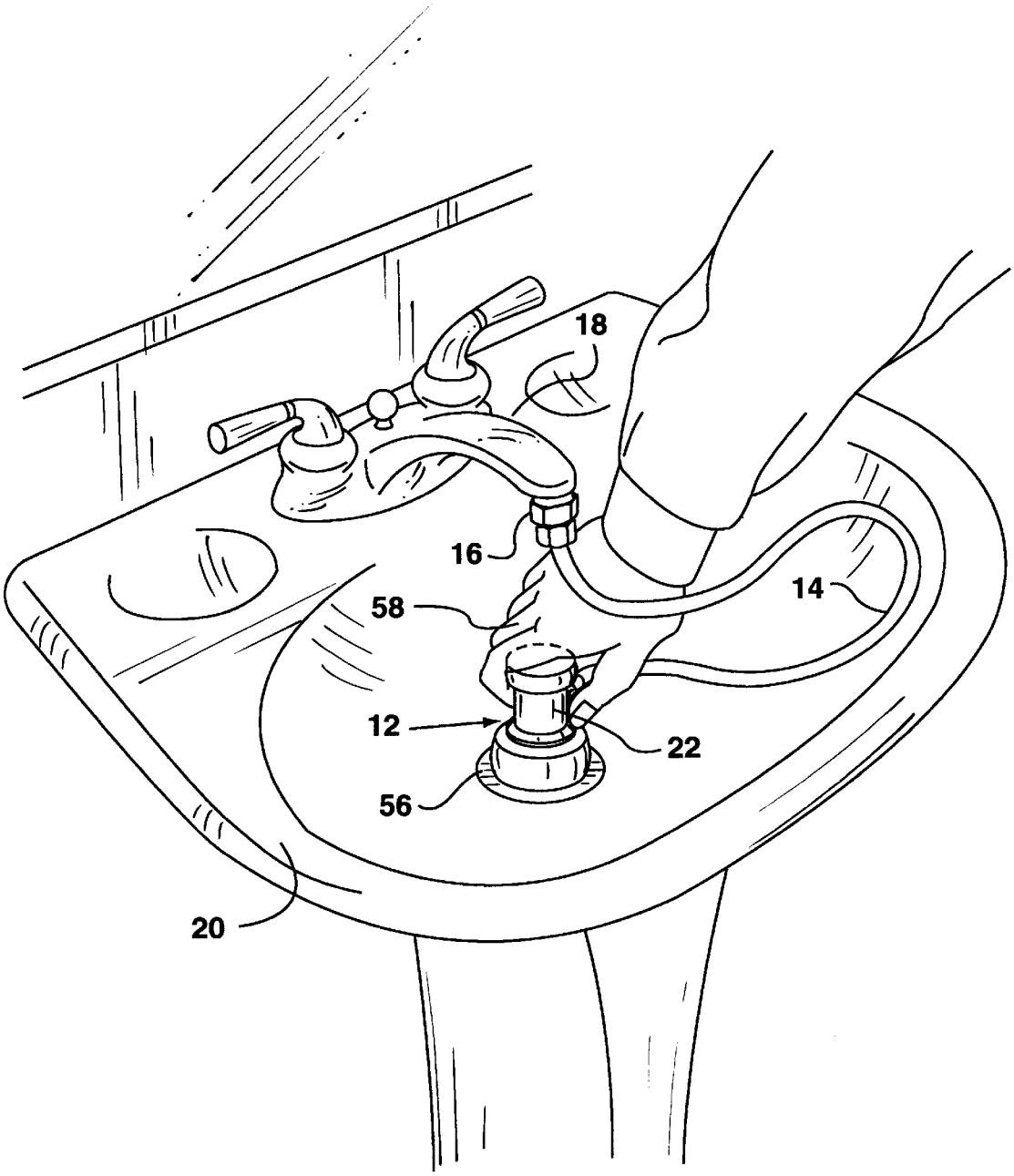
FIG. 1 is a pictorial view of apparatus in accordance with one embodiment of the invention being used to flush a drain pipe of a domestic wash basin.

It will usually only be necessary for the operator to place one hand on the cap 52 as shown in FIGS. 1 and 5, not both hands.

Other embodiments of the invention will be readily apparent to a person skilled in the art. For example, apparatus in accordance with the invention may also be used to flush and/or unblock drain pipes of sinks, showers or floor drains. The scope of the invention is defined in the appended claims.

We claim:

1. Apparatus for flushing a drain pipe with an accessible open end, said apparatus including:

a valve assembly with a hollow body connectable to a source of liquid under pressure for the supply of liquid under pressure to the interior of the hollow body, the hollow body having an open end positionable in communication with the open end of the drain pipe, a valve member mounted for sliding movement in the valve body between a closed position in which the valve member prevents flow of liquid under pressure from the source thereof through the hollow body to the open end thereof, and an open position in which the valve member permits flow of liquid from the source thereof through the hollow body to the open end thereof, the valve member having an actuating portion projecting from an opposite end of the hollow body, and spring means biasing the valve member towards the closed position, the actuating portion of the valve member being manually engageable to move the valve member by manual pressure to the open position against the action of the spring means, when the open end of the hollow body has been positioned over the open end of the drain pipe and the hollow body has been connected to the source of liquid under pressure, whereby the valve assembly is held against the open end of the drain pipe by said manual pressure and liquid under pressure from the source thereof flows through the hollow body into the drain pipe to flush undesirable matter therefrom and/or to dislodge blocking material in the pipe, the spring means surrounding the valve member within the hollow body and acting between a stop projecting inwardly from the hollow body and the actuating portion of the valve member, the valve member carrying two vertically spaced sealing rings engaging the interior of the hollow body above and below a circumferential recess in the valve member, the circumferential recess being in communication with an inlet through which the liquid under pressure is supplied to the interior of the hollow body, and the valve member being movable downwardly by manual pressure on the actuating portion against the action of the spring means to an open position in which the lower sealing ring is out of engagement with the interior of the hollow body to permit the liquid under pressure to flow from the inlet through the circumferential recess and through the open end of the hollow body, and the interior of the hollow body being provided with guides spaced at intervals around the interior thereof to guide the lower sealing ring when the valve member is moved to the open position.

2. Apparatus according to claim 1 wherein upward movement of the valve member is limited by engagement of an annular shoulder extending around the valve member with the stop projecting inwardly from the hollow body.

3. Apparatus according to claim 1 wherein the valve assembly also has an annular adaptor mountable on the open end of the hollow valve body, the adaptor having a large diameter tubular end portion engageable with the exterior of the open end of the hollow valve body, and a smaller diameter opposite end portion engageable with the interior of the open end of the hollow valve body.

* * * * *